US006216269B1

(12) United States Patent
Smith et al.

(10) Patent No.: US 6,216,269 B1
(45) Date of Patent: Apr. 17, 2001

(54) COMBINATION GARMENT BIB SYSTEM

(76) Inventors: Edith Smith; Robby Smith, both of 10342 S. Forest, Chicago, IL (US) 60628

( * ) Notice: Subject to any disclaimer, the term of this patent is extended or adjusted under 35 U.S.C. 154(b) by 0 days.

(21) Appl. No.: 09/456,657

(22) Filed: Dec. 8, 1999

(51) Int. Cl.[7] ..... A41B 13/10

(52) U.S. Cl. ..... 2/46; 2/49.4; 2/49.5

(58) Field of Search ..... 2/48, 49.1, 49.2, 2/49.3, 49.4, 49.5, 114, 104, 111, 80, 52, 46, 118, 119, 120, 121, 105, 106, 75

(56) References Cited

U.S. PATENT DOCUMENTS

| | | | | |
|---|---|---|---|---|
| 540,756 | * | 6/1895 | Odell | 2/49.2 |
| 1,808,496 | * | 6/1931 | Dillon | 2/111 |
| 2,643,384 | | 6/1953 | Thompson | 2/49 |
| 2,766,456 | | 10/1956 | Nigio | 2/49 |
| 2,767,403 | | 10/1956 | Givens | 2/49 |
| 3,259,913 | * | 7/1966 | Tames | 2/48 |
| 3,608,092 | * | 9/1971 | Taranto | 2/49 R |
| 4,639,946 | * | 2/1987 | Koenig | 2/49 R |
| 4,754,500 | * | 7/1988 | Brucato et al. | 2/114 |
| 4,797,952 | * | 1/1989 | Petrini | 2/49 R |
| 5,146,626 | * | 9/1992 | Rosado | 2/105 |
| 5,432,952 | | 7/1995 | Tate | 2/49.2 |
| 5,454,119 | * | 10/1995 | Thomm | 2/49.2 |
| 5,490,289 | | 2/1996 | Lehrer | 2/49.2 |
| 5,640,715 | * | 6/1997 | Adams | 2/46 |
| 5,802,610 | | 9/1998 | Burr | 2/49.4 |
| 6,032,287 | * | 3/2000 | Kallas | 2/80 |

FOREIGN PATENT DOCUMENTS

| | | | | |
|---|---|---|---|---|
| 749066 | * | 5/1956 | (GB) | 2/49.5 |

* cited by examiner

*Primary Examiner*—Amy B. Vanatta
(74) *Attorney, Agent, or Firm*—Joseph N. Breaux

(57) ABSTRACT

A combination garment bib system that includes a garment having an absorbent layer backed by a fluid impermeable layer positioned in front of the neck opening of the garment and a bib having an absorbent layer backed by a fluid impermeable layer. The bib is attachable to the garment at the front of the neck opening such that the bib provides the primary protection while the garment provides an addition protective element.

1 Claim, 2 Drawing Sheets

COMBINATION GARMENT BIB SYSTEM

TECHNICAL FIELD

The present invention relates to baby bibs and more particularly to a combination garment bib system that includes a bib portion that is attachable to a garment portion; the garment portion including a shirt garment having a neck opening and being constructed of absorbent garment material, an impermeable layer being provided around the front of the neck opening beneath the garment material and a number of garment hook and pile fastener tabs being spaced and provided around the front of the neck opening on the exterior surface of the garment material; the bib portion having an absorbent top layer backed by a fluid impermeable layer to which a number of bib hook and pile fastener sections are attached and spaced such that the bib hook and pile fastener sections correspond to and simultaneously companionately connect with the garment hook and pile fastener tabs to hold the bib portion in place during use.

BACKGROUND ART

It is often desirable to have a bib when feeding a small infant or child. Because the bibs can twist around and be moved by the child, it would be a benefit to have a combination garment bib system that included a garment having an absorbent layer backed by a fluid impermeable layer positioned in front of the neck opening of the garment and a bib having an absorbent layer backed by a fluid impermeable layer that could be attached to the garment at the front of the neck opening such that the bib provides the primary protection while the garment provides an addition protective element.

GENERAL SUMMARY DISCUSSION OF INVENTION

It is thus an object of the invention to provide a combination garment bib system that includes a bib portion that is attachable to a garment portion; the garment portion including a shirt garment having a neck opening and being constructed of absorbent garment material, an impermeable layer being provided around the front of the neck opening beneath the garment material and a number of garment hook and pile fastener tabs being spaced and provided around the front of the neck opening on the exterior surface of the garment material; the bib portion having an absorbent top layer backed by a fluid impermeable layer to which a number of bib hook and pile fastener sections are attached and spaced such that the bib hook and pile fastener sections correspond to and simultaneously companionately connect with the garment hook and pile fastener tabs to hold the bib portion in place during use.

Accordingly, a combination garment bib system is provided. The combination garment bib system includes a bib portion that is attachable to a garment portion; the garment portion including a shirt garment having a neck opening and being constructed of absorbent garment material, an impermeable layer being provided around the front of the neck opening beneath the garment material and a number of garment hook and pile fastener tabs being spaced and provided around the front of the neck opening on the exterior surface of the garment material; the bib portion having an absorbent top layer backed by a fluid impermeable layer to which a number of bib hook and pile fastener sections are attached and spaced such that the bib hook and pile fastener sections correspond to and simultaneously companionately connect with the garment hook and pile fastener tabs to hold the bib portion in place during use.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
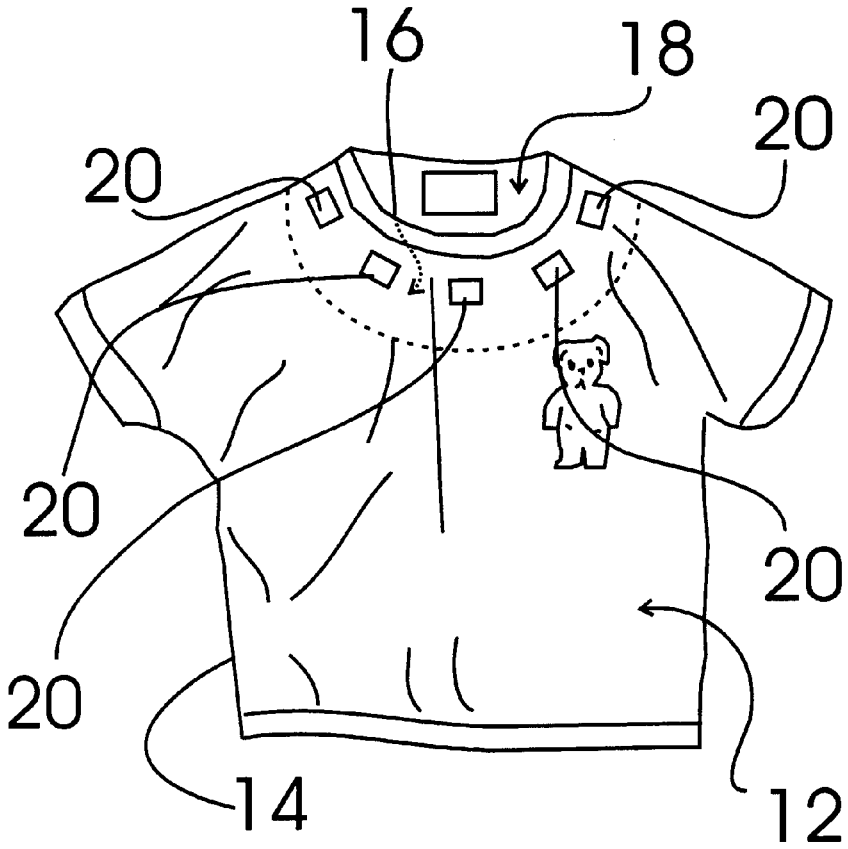
FIG. 1 is a front plan view of the garment portion of the combination garment bib system of the present inventions showing a shirt garment having an impermeable layer provided around the front neck opening beneath the garment material and a number of garment hook and pile fastener tabs spaced and provided around the neck opening provided on the exterior surface of the garment material.
Figure 3:
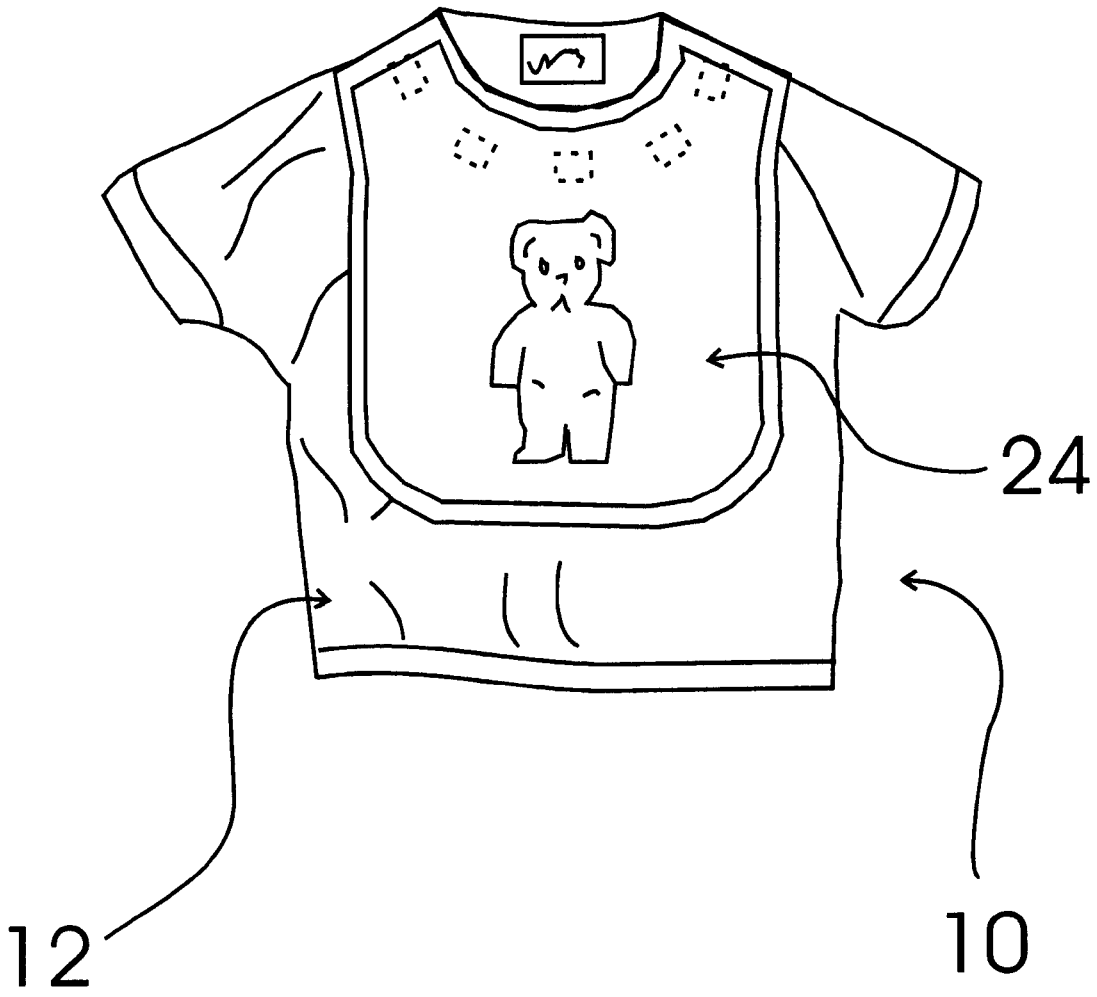
FIG. 3 is a front plan view of the combination garment bib system of the present invention with the bib portion attached to the garment portion by contact between the bib hook and pile fastener sections with the garment hook and pile fastener tabs.

FIG. 1 shows an exemplary garment portion, generally designated 10, of the combination garment bib system of the present invention, generally designated 12, FIG. 3. Garment portion 12 includes a shirt garment 14 having an impermeable layer 16 provided around a front portion surrounding a neck opening 18 beneath the absorbent garment material of which shirt garment 14 is constructed. Five garment hook and pile fastener tabs 20 are spaced and provided around neck opening 18 the exterior surface of shirt garment 14.

Figure 2:
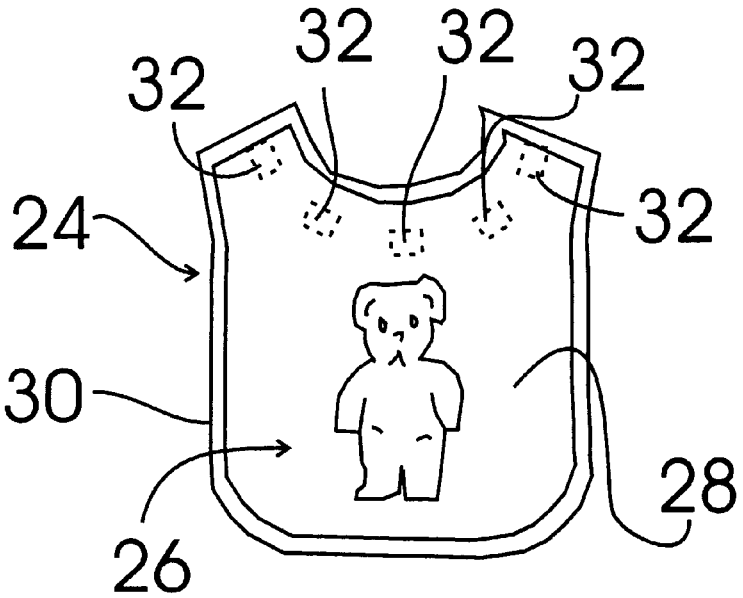
FIG. 2 is a front plan view of an exemplary embodiment of the bib portion of the combination garment bib system of the present inventions showing a bib having an absorbent top layer backed by a fluid impermeable layer to which a number of bib hook and pile fastener sections are attached and spaced to correspond to and simultaneously connect with the garment hook and pile fastener tabs.

FIG. 2 shows an exemplary embodiment of the bib portion, generally designated 24, of the combination garment bib system 10 (FIG. 1). Bib portion 24 includes a bib 26 having an absorbent top layer 28 backed by a fluid impermeable layer 30 to which five bib hook and pile fastener sections 32 are attached and spaced to correspond to and simultaneously connect with garment hook and pile fastener tabs 20 to, with reference to FIG. 3, attach bib portion 24 to garment portion 12.

It can be seen from the preceding description that a combination garment bib system has been provided that includes a bib portion that is attachable to a garment portion; the garment portion including a shirt garment having a neck opening and being constructed of absorbent garment material, an impermeable layer being provided around the front of the neck opening beneath the garment material and a number of garment hook and pile fastener tabs being spaced and provided around the front of the neck opening on the exterior surface of the garment material; the bib portion having an absorbent top layer backed by a fluid impermeable layer to which a number of bib hook and pile fastener sections are attached and spaced such that the bib hook and pile fastener sections correspond to and simultaneously companionately connect with the garment hook and pile fastener tabs to hold the bib portion in place during use.

It is noted that the embodiment of the combination garment bib system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combination garment bib system consisting of:

a garment portion; and a bib portion attachable to said garment portion;

said garment portion including a shirt garment having a neck opening and being constructed of absorbent garment material, an impermeable layer being provided only around said front of said neck opening beneath said garment material, a number of garment hook and pile fastener tabs being spaced and provided around said front of said neck opening on said exterior surface of said garment material;

said bib portion having an absorbent top layer backed by a fluid impermeable layer to which a number of bib hook and pile fastener sections are attached and spaced such that said bib hook and pile fastener sections correspond to and simultaneously companionately connect with said garment hook and pile fastener tabs to hold said bib portion in place during use.

* * * * *